US006779318B2

(12) United States Patent
Wang

(10) Patent No.: US 6,779,318 B2
(45) Date of Patent: Aug. 24, 2004

(54) SYSTEM AND METHOD FOR CONTINUOUSLY FORMING, SEALING AND FILLING FLEXIBLE PACKAGES

(75) Inventor: James J. Wang, Sugar Land, TX (US)

(73) Assignee: The Coca-Cola Company, Atlanta, GA (US)

( * ) Notice: Subject to any disclaimer, the term of this patent is extended or adjusted under 35 U.S.C. 154(b) by 62 days.

(21) Appl. No.: 09/788,516

(22) Filed: Feb. 21, 2001

(65) Prior Publication Data

US 2002/0112447 A1 Aug. 22, 2002

(51) Int. Cl.[7] ..... B65B 61/00; B65B 55/04; B65B 9/04

(52) U.S. Cl. ..... 53/410; 53/167; 53/133.1; 53/425; 53/450; 53/550

(58) Field of Search ..... 53/456, 459, 410, 53/167, 133.1, 562, 563, 425, 426, 450, 451, 550, 551, 554, 553

(56) References Cited

U.S. PATENT DOCUMENTS

| | | | | |
|---|---|---|---|---|
| 3,246,444 A | * | 4/1966 | Paisley | 222/107 |
| 3,568,734 A | * | 3/1971 | Vadas et al. | 141/140 |
| 3,738,080 A | | 6/1973 | Reil | 53/180 |
| 3,911,642 A | | 10/1975 | Ernstsson et al. | 53/28 |
| 4,069,153 A | | 1/1978 | Gunther | 210/64 |
| 4,121,107 A | * | 10/1978 | Bachmann | 250/455.11 |
| 4,216,639 A | * | 8/1980 | Gautier | 426/410 |
| 4,255,383 A | | 3/1981 | Schenck | 422/24 |
| 4,289,728 A | | 9/1981 | Peel et al. | 422/24 |
| 4,366,125 A | | 12/1982 | Kodera et al. | 422/295 |
| 4,375,145 A | | 3/1983 | Mosse et al. | 53/425 |
| 4,384,440 A | * | 5/1983 | Ohlsson | 426/124 |
| 4,448,750 A | | 5/1984 | Fuesting | 422/20 |
| 4,512,136 A | * | 4/1985 | Christine | 383/122 |
| 4,566,251 A | * | 1/1986 | Spisak et al. | 53/167 |

(List continued on next page.)

FOREIGN PATENT DOCUMENTS

| | | | |
|---|---|---|---|
| DE | 28 28 881 | * 6/1978 | B65D/85/72 |
| WO | WO 92/18170 | 10/1992 | |
| WO | WO 98/40273 | 9/1998 | |
| WO | WO 99/08932 | 2/1999 | |
| WO | WO 99/08934 | 2/1999 | |
| WO | WO 00/00394 | 1/2000 | |

OTHER PUBLICATIONS

Naito Shigezo et al. Method and Device for Sterilizing Packing Material, Abstract of JP 05178334, Jul. 20, 1993.

Ota Toshiyuki et al., Ozone Sterilization Method for Aqueous Solution System, Abstract of JP 06226273, Aug. 16, 1994.

*Primary Examiner*—Rinaldi I. Rada
*Assistant Examiner*—Paul Durand
(74) *Attorney, Agent, or Firm*—Finnegan, Henderson, Farabow, Garrett & Dunner, L.L.P.

(57) ABSTRACT

A system and method of continuously forming, sealing, and filling flexible packages with sterile beverages is disclosed wherein the forming, sealing, and filling is performed without stopping or indexing the packages in order to achieve high throughput rates and efficiency. A web feeding device inputs sheet material into the system, which is continuously formed into a series of juxtaposed shaped packages in a forming unit. The packages are formed by a folding technique resulting in top and bottom gussets, and sealed side seams with an open top for filling thereof with liquid. The entire web of formed packages is transported through a filling device, which continuously fills the packages while in web form. The top fill openings of the packages are then sealed in a continuous process, and fabrication within an aseptic or ultra-clean environment is thereby completed. Post-treatment of the packages outside of the aseptic environment, but in a clean environment, then may proceed. Such post-treatment may include the securing of drinking straws to the packages, severing of the package into individual packages, and secondary packaging of the individual packages into cases or multi-pacs.

16 Claims, 5 Drawing Sheets

U.S. PATENT DOCUMENTS

| | | | | | |
|---|---|---|---|---|---|
| 4,590,740 | A | | 5/1986 | Rodocker | 53/426 |
| 4,656,813 | A | | 4/1987 | Baldini et al. | 53/410 |
| 4,774,797 | A | * | 10/1988 | Colamussi et al. | 53/459 |
| 4,797,255 | A | | 1/1989 | Hatanaka et al. | 422/28 |
| 4,809,485 | A | | 3/1989 | Nielsen | 53/503 |
| 4,848,063 | A | | 7/1989 | Niske | 53/451 |
| 4,896,768 | A | | 1/1990 | Anderson | 206/210 |
| 4,907,394 | A | * | 3/1990 | Tschepke et al. | 53/412 |
| 4,910,942 | A | | 3/1990 | Dunn et al. | 53/425 |
| 5,047,072 | A | | 9/1991 | Wertz et al. | 55/1 |
| 5,073,268 | A | | 12/1991 | Saito et al. | 210/638 |
| 5,114,670 | A | | 5/1992 | Duffey | 422/24 |
| 5,122,340 | A | | 6/1992 | Shimamura et al. | 422/28 |
| 5,129,212 | A | | 7/1992 | Duffey et al. | 53/426 |
| 5,135,714 | A | | 8/1992 | Wang | 422/23 |
| 5,144,670 | A | | 9/1992 | Negishi | 381/24 |
| 5,155,980 | A | | 10/1992 | Mansson et al. | 53/551 |
| 5,158,816 | A | | 10/1992 | Rausing | 428/35.8 |
| 5,181,365 | A | * | 1/1993 | Garvey et al. | 493/196 |
| 5,213,759 | A | | 5/1993 | Castberg et al. | 422/24 |
| 5,326,542 | A | | 7/1994 | Sizer et al. | 422/291 |
| 5,348,525 | A | * | 9/1994 | Buchanan | 493/213 |
| 5,348,665 | A | | 9/1994 | Schulte et al. | 210/748 |
| 5,350,568 | A | | 9/1994 | Tuckner et al. | 422/300 |
| 5,353,573 | A | * | 10/1994 | Durrant | 53/133.1 |
| 5,428,078 | A | | 6/1995 | Cohen et al. | 522/2 |
| 5,433,920 | A | | 7/1995 | Sizer et al. | 422/24 |
| 5,445,793 | A | | 8/1995 | Tuckner et al. | 422/28 |
| 5,489,022 | A | | 2/1996 | Baker | 206/439 |
| 5,494,691 | A | | 2/1996 | Sizer | 426/392 |
| 5,669,208 | A | * | 9/1997 | Tabaroni et al. | 53/453 |
| 5,730,934 | A | | 3/1998 | Holbert | 422/24 |
| 5,843,374 | A | | 12/1998 | Sizer et al. | 422/24 |
| 5,979,142 | A | * | 11/1999 | Kraft et al. | 53/133.1 |
| 6,039,922 | A | | 3/2000 | Swank et al. | 422/24 |
| 6,056,918 | A | | 5/2000 | Palaniappan et al. | 422/24 |
| 6,076,334 | A | * | 6/2000 | Kitahora et al. | 53/426 |
| 6,094,887 | A | | 8/2000 | Swank et al. | 53/426 |
| 6,120,730 | A | | 9/2000 | Palaniappan et al. | 422/28 |
| 6,183,691 | B1 | | 2/2001 | Swank et al. | 422/24 |
| 6,185,910 | B1 | * | 2/2001 | Achhammer | 134/73 |

OTHER PUBLICATIONS

Dainippon Printing, Derwent Abstract of JP 09240629, Sep. 16, 1997.

Naito Akira et al., Bathing Water Circulating and Filtering System, Abstract of JP 09285413, Nov. 4, 1997.

Hirashiki Isamu et al., Sterilizing Method and Apparatus, Abstract of JP 11226579, Aug. 24, 1999.

Fukuda Masahiko et al., Apparatus for Sterilization by Ultra Violet Radiation, Abstract of JP 11319817, Nov. 24, 1999.

Murao Kazunori et al., Process and Device for Sterilization, Abstract of JP 11342919, Dec. 14, 1999.

Kitada Takuya et al., Method and Device for Sterilization of Packaging–Material, Abstract of JP 2000142641, May 23, 2000.

* cited by examiner

SYSTEM AND METHOD FOR CONTINUOUSLY FORMING, SEALING AND FILLING FLEXIBLE PACKAGES

BACKGROUND OF THE INVENTION

1. Field of the Invention

The present invention relates to a method and system for continuously forming, sealing and filling flexible packages with materials in order to achieve a rapid throughput of packages at the output of a conveyor system. More specifically, the present invention relates to a system and method for continuously forming, sealing and filling flexible packages with hot pasteurized or sterile beverages in an aseptic or ultra-clean environment, and post-treating the package emerging from the sterile environment in a clean environment in route to a case packer, or other secondary package-forming apparatus.

2. Description of Related Art

Heretofore, the forming, sealing and filling of flexible packages, and particularly aseptic packages, have been performed by various techniques and apparatus. But, due to the nature of the packages to be filled and formed, and the aseptic environment requirements, conventional systems have not had sufficiently rapid throughput to achieve the desired efficiencies in the assembly line.

Preferably, it is desirable to achieve 80 to 85% efficiency of the assembly line, but heretofore such efficiencies have not been achievable. Accordingly, a need in the art exists for a system and method for continuously forming, sealing and filling flexible packages at increased rates of speed as compared to prior techniques and systems.

SUMMARY OF THE INVENTION

Accordingly, it is a primary aspect of the present invention to provide a method and system for continuously forming, sealing and filling flexible packages at high efficiencies and throughput speeds.

It is another aspect of the present invention to provide a system that continuously forms the flexible packages from a continuous web of flexible material fed from roll-stock, wherein the packages formed have bottom and top gussets.

In another aspect of the present invention, the continuous web of material is continuously formed and filled with liquid in continuous motion without stopping or indexing the packages through various operational stations of the conveyor system.

These and other aspects of the present invention are achieved by providing a method of continuously forming, sealing and filling flexible packages with materials comprising the steps of:

a) feeding a continuous web of plastic sheet material into a package-forming unit;

b) outputting a continuous web of packages including a series of juxtaposed shaped packages from the forming unit, the shaped packages having a closed bottom; two open sides, and an open top defining a fill opening;

c) sealing the open sides while continuously feeding the web of packages through a side-seaming unit;

d) filling the packages with liquid through said open tops while continuously feeding the web of packages through a filling unit;

e) sealing the open top of the respective packages while continuously feeding the web of packages through a top sealing unit; and f) severing the respective filled and sealed packages from the web to form individual packages therefrom.

In the method of the present invention, a step of sterilizing the web may be performed between the foregoing steps a) and b) if the packages to be filled are to be sterilized.

In the method of the present invention, steps a) to e) described above are preferably performed within an aseptic or ultra-clean environment. But, the severing of the respective filled and sealed packages from the web to form individual packages therefrom; securing a drinking straw to each package on the web, and forming secondary packages are merely performed in a clean, rather than an aseptic or sterile environment.

The present invention also relates to a system including various means and units in combination for performing the above enumerated steps of the method of the present invention.

Other variations in the present invention may include a step for attaching a spout to the fill opening of the packages; filling the packages with low acid, beverages, or foods such as milk products higher acid beverages such as citrus juices; particulate material including citrus pulp, or fruit particles; and use of foil-plastic and plastic-plastic laminates for the web material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
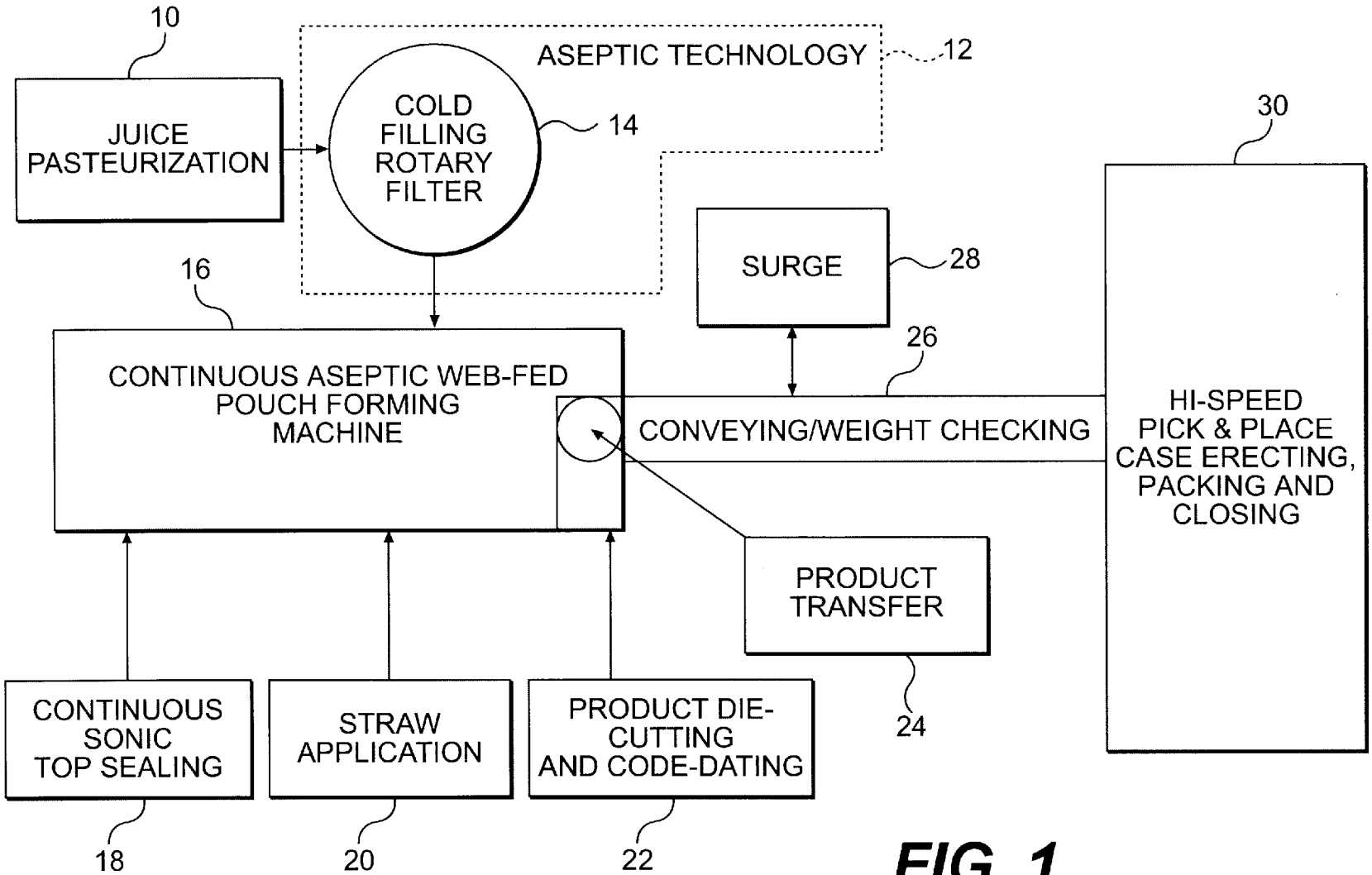
FIG. 1 is a schematic block diagram of a system and method for filling flexible packages in an aseptic environment according to the present invention.

Referring to FIG. 1, there is illustrated a complete system for filling and sealing flexible packages, in an aseptic or ultra-clean environment followed by a clean environment for post-treatment of the packages and secondary packaging.

A source of pasteurized juice or other beverages 10 is provided to feed liquid to a cold filling rotary filler 14 disposed within an aseptic enclosure 12. A continuous aseptic web-fed pouch forming machine 16 forms packages in the web in juxtaposed positions at a rate of about 600 ppm for 200 ml packages and 300 ppm for 330 ml packages. The pouch forming machine 16 includes a gusset forming mechanism to be described hereinafter, as well as a side sealing mechanism 8 and a top sealing mechanism 18.

External to the aseptic or ultra-clean environment, but within a clean environment, there is provided a straw application device 20, a product die-cutting and code-dating device 22, and a hi-speed pick and place case erecting, packing and closing mechanism 30 at the output to the system. A product transfer conveyor system 24 is provided between the output of the aseptic web forming machine 16 and secondary packaging device 30, and such a conveyor system may include package weight monitoring detectors and surge protectors 28 to provide an even, continuous throughput of formed and filled packages.

Figure 2:
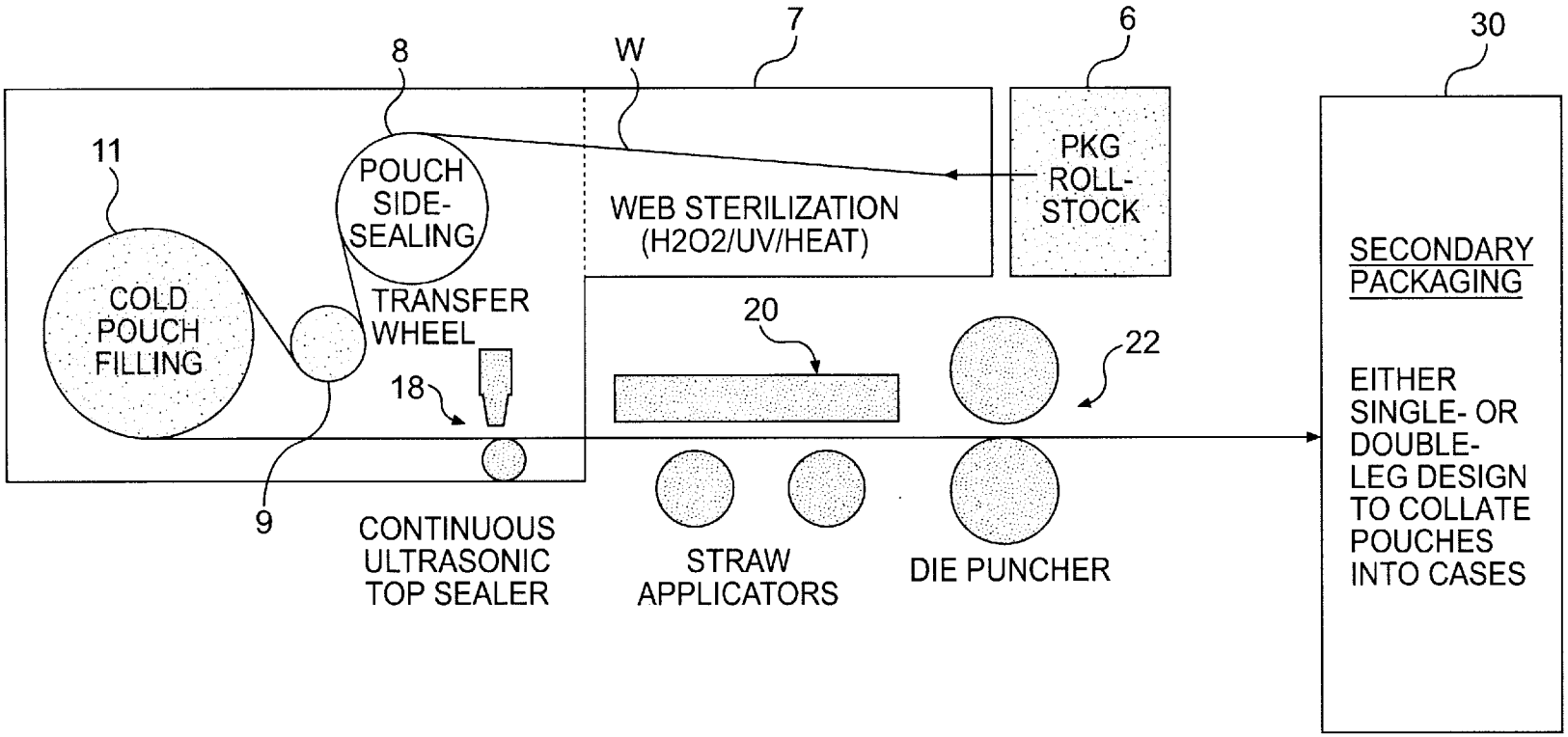
FIG. 2 is a schematic block diagram showing further details of the forming, filling and sealing system of FIG. 1.

FIG. 2 discloses more detail of the package forming and sterilization mechanisms for use in the system of FIG. 1, and like reference numerals therein refer to like parts of the respective figures. The sheet material from which the web W is formed may be provided on a package roll-stock feeder 6. The web W then proceeds through a sterilization mechanism 7, which preferably treats the web material with hydrogen peroxide, ultraviolet radiation and heat. The web W emerges from sterilizer 7, and travels through a pouch side-sealing turret 8, which forms side seams of the pouches P to be illustrated in more detail hereinafter with reference to FIG. 5. The web W passes around an idler roller 9 to the perimeter of a cold pouch filling machine 11, also depicted more completely in FIGS. 3 and 5. Filled pouches on the web W emerging from filler 11 pass on through a continuous ultrasonic top sealer 18, which seals the top opening of the filled packages. At this point, the packages may pass from the aseptic or ultra-clean environment to merely a clean environment because the packages with sterile liquid or other materials therein have been hermetically sealed. Emerging from sealer 18, web W passes through a straw applicator 20, which may secure a straw to each package. The web W then passes through a die 22 puncture or cutter, and the sealed packages are separated into individual packages for processing by secondary packages 30, which may form cases, multi-pacs, and so forth at speeds of about 720 ppm.

Figure 3:
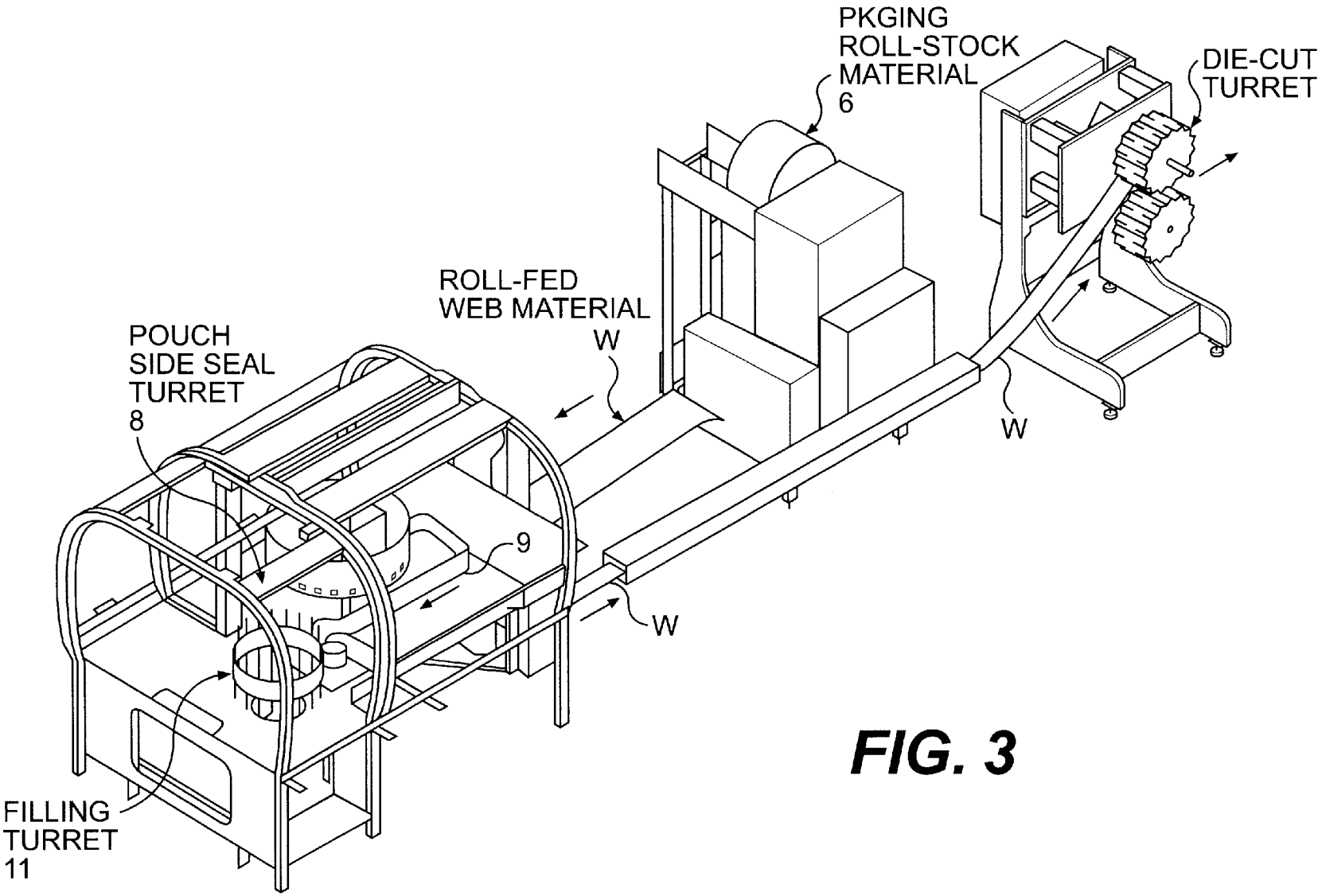
FIG. 3 is a perspective view showing one possible embodiment of the apparatus for performing the method of the system of FIG. 1.

FIG. 3 is a perspective view showing one embodiment of the physical shape and inner connection of the components of the system of FIG. 2. As depicted in FIG. 3, the roll-stock material 6 is provided on a spool which feeds the web W sheet material into and through a sterilizer, a gusset former, a side seal turret 8, and a rotary filling turret 11; and is output through a conveyor and straw applicator, and die-cutting turret 22 described hereinbefore. Various physical forms of the components of the system in FIG. 3 may be utilized without departing from the spirit and scope of the present invention.

Figure 4:
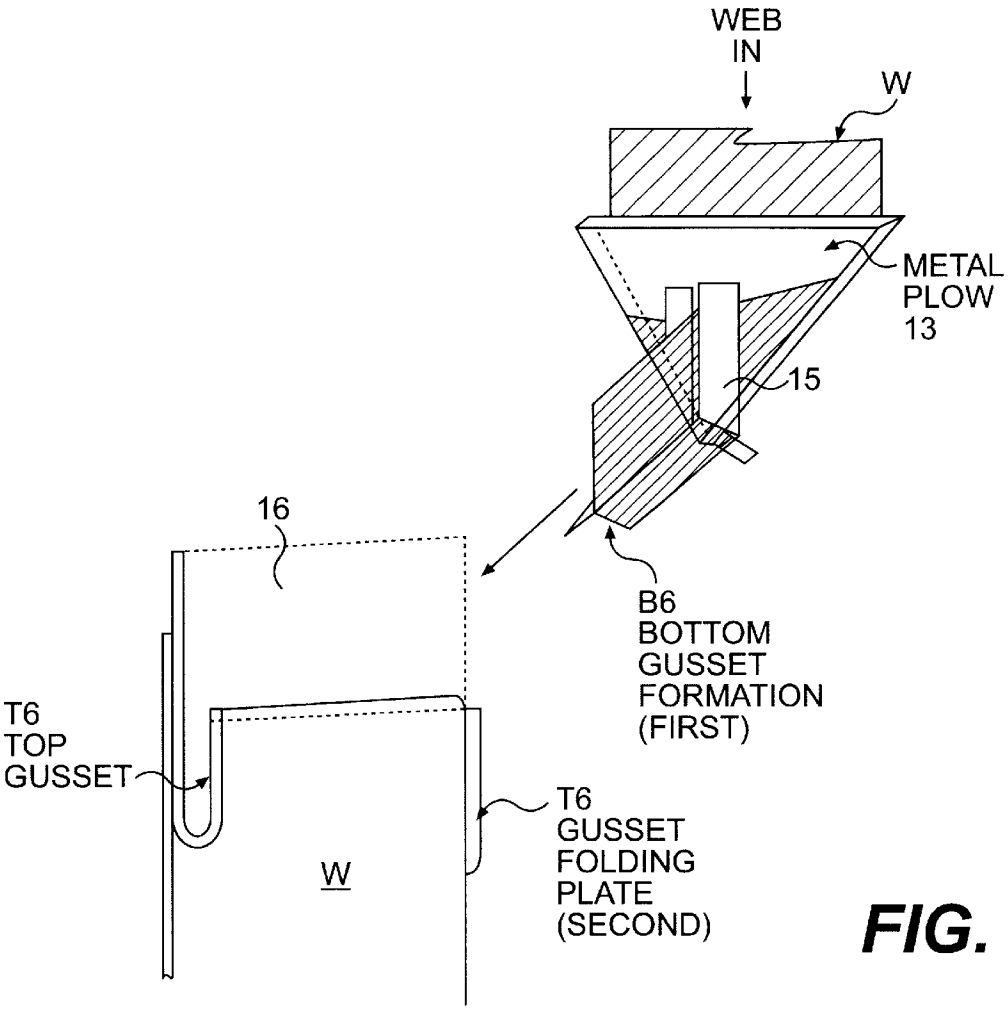
FIG. 4 is a diagrammatic illustration of a forming portion of the flexible packages of the system of FIG. 1 showing the detail of formation of top and bottom gusset structures for the flexible packages.

Referring to FIG. 4, there is illustrated an embodiment of a gusset forming mechanism for forming top and bottom gussets of the flexible packages P in accordance with the present invention. The web W is fed through a metal plow 13, including a funnel-shaped channel with an output slot defined by a pair of plates 15. A bottom gusset BG emerges from the slot and passes with web W into a station for forming a top gusset TG of the package P. The top gusset forming mechanism includes a top gusset folding plate 16, which forms top gusset TG in web W. The packages P with gussets formed therein is then transported to the side seam forming mechanism 8 of FIG. 2.

Figure 5:
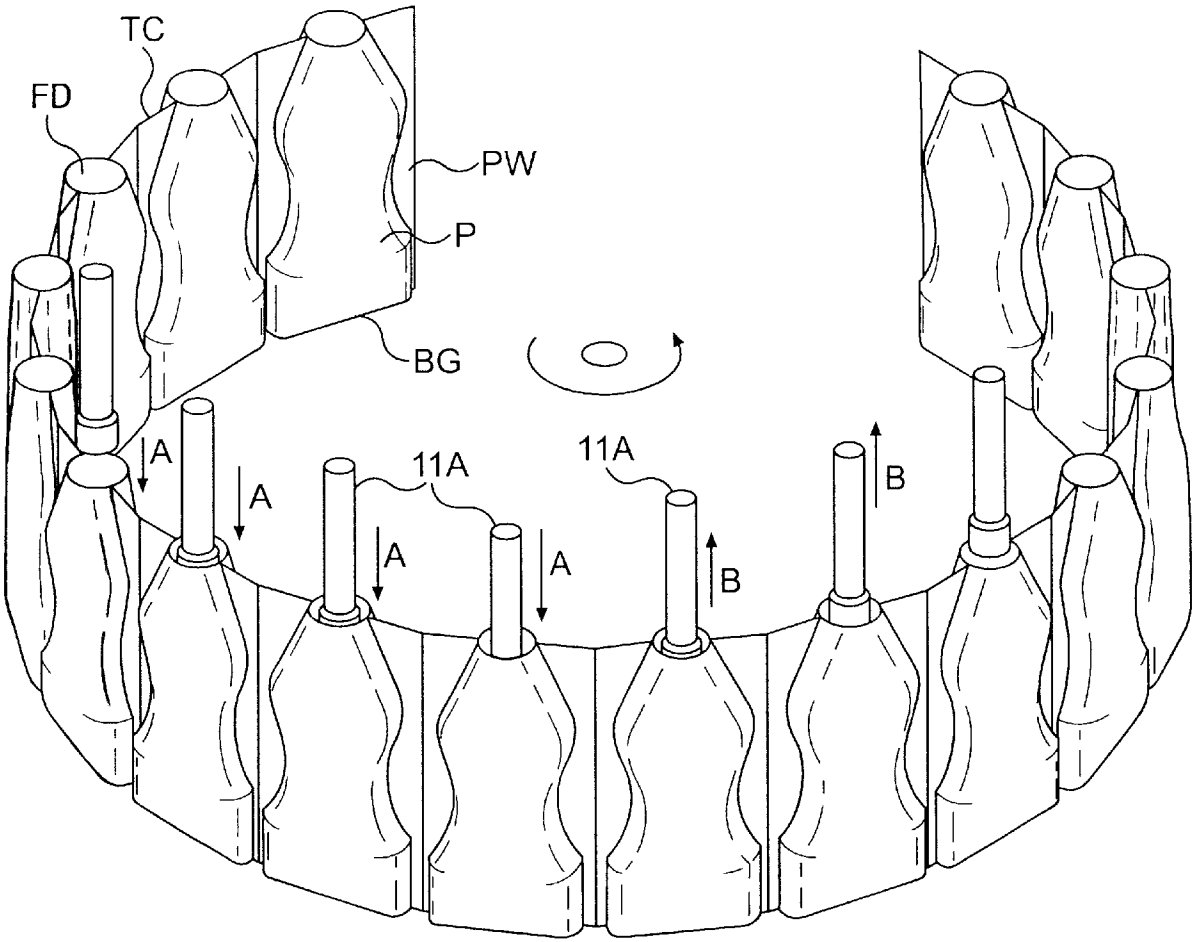
FIG. 5 is a perspective view showing a rotary filling turret and nozzle assembly for filling flexible packages formed in a continuous web in accordance with the aspects of the present invention.

The package P, in accordance with the preferred embodiment of the present invention, includes a bottom gusset BG, a top gusset TG, a fill opening FO, and a waist portion PW, which facilitates comfortable gripping and handling of the packages by a consumer. As illustrated in FIG. 5, liquid is introduced into openings FO by nozzles 11A of the rotary filler 11. Arrows A indicate the introduction of nozzles 11A into openings FO, and arrows B indicate the removal of those nozzles from the openings after filling is complete. In other words, the rotary filler permits the rapid and continuous filling of the packages P through the top openings FO without stopping or indexing the packages during the filling operation.

The packages P may be formed from plastic, laminates of plastic, flexible foil laminates, combinations of foil and plastic, or any other suitable flexible materials.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of continuously forming, sealing and filling flexible packages with materials, comprising:

feeding a continuous web of plastic sheet material into a package-forming unit;

outputting a continuous web of packages including a series of juxtaposed shaped packages from the forming unit, the shaped packages having a closed bottom; two open sides, and an open top defining a fill opening;

sealing the open sides while continuously feeding the web of packages through a side-seaming unit;

filling the packages with liquid through said open tops while continuously feeding the web of packages through a filling unit;

sealing the open top of the respective packages while continuously feeding the web of packages through a top sealing unit;

severing the respective filled and sealed packages from the web to form individual packages therefrom;

maintaining a sterile environment during said outputting, said sealing the open sides, said filling, and said sealing the open top; and maintaining a clean, but non-sterile, environment during said severing.

2. The method of claim 1 further comprising the step of:

securing a drinking straw to each package on the web between said sealing the open top and said severing.

3. The method of claim 1 wherein the package output is about 660 packages per minute for 200 ml pouches.

4. The method of claim 1 wherein the forming unit continuously folds said plastic sheet material along a longitudinal axis to form a longitudinal gusset that forms the package bottom.

5. The method of claim 4 wherein said forming unit then continuously forms a top gusset structure for each package.

6. The method of claim 1 further comprising the step of:

sterilizing the web between said feeding and said outputting.

7. The method of claim 2 further comprising the step of:

securing a drinking straw to each package on the web between said sealing the open top and said severing.

8. The method of claim 7 further comprising the step of:

maintaining a clean, but non-sterile, environment during the securing of a drinking straw.

9. A system for continuously forming, sealing and filling flexible package with liquid, comprising:

means for feeding a continuous web of plastic sheet material into a package forming a unit;

means for outputting a continuous web of packages including a series of juxtaposed shaped packages from the forming unit, the shaped packages having a closed bottom, two open sides, and an open top defining a fill opening;

means for sealing the open sides while continuously feeding the web of packages through a side-seaming unit;

means for filling the packages with liquid through said open tops while continuously feeding the web of packages through a filling unit;

means for sealing the open top of the respective packages while continuously feeding the web of packages through a top sealing unit;

means for severing the respective filled and sealed packages from the web to form individual packages therefrom;

means for maintaining a sterile environment proximate the means for outputting, the means for sealing the open sides, the means for filling, the means for sealing the open top; and means for maintaining a clean, but non-sterile, environment proximate the means for severing.

10. The system of claim 7 further comprising:

means for securing a drinking straw to each package on the web after the open top is sealed and before the filled and sealed packages are severed.

11. The system of claim 7 wherein the forming unit continuously folds said plastic sheet material along a longitudinal axis to form a longitudinal gusset that forms the package bottom.

12. The system of claim 11 wherein said forming unit then continuously forms a top gusset structure for each package.

13. The system of claim 9 wherein the means for outputting is configured to output about 660 packages per minute for 200 ml pouches.

14. The system of claim 7 further comprising:

means for sterilizing the web after the continuous web of plastic sheet material is fed into a package and before the continuous web of packages is output.

15. The system of claim 8 further comprising:

means for securing a drinking straw to each package on the web after the open top is sealed and before the filled and sealed packages are severed.

16. The system of claim 9 further comprising:

means for maintaining a clean, but non-sterile, environment around said means for securing a drinking straw.

* * * * *

UNITED STATES PATENT AND TRADEMARK OFFICE

CERTIFICATE OF CORRECTION

PATENT NO. : 6,779,318 B2
DATED : August 24, 2004
INVENTOR(S) : James J. Wang

It is certified that error appears in the above-identified patent and that said Letters Patent is hereby corrected as shown below:

Column 5,
Line 1, “claim 2” should read -- claim 6 --.

Column 6,
Lines 5, 9 and 18, “claim 7” should read -- claim 9 --.
Line 22, “claim 8” should read -- claim 14 --.
Line 26, “claim 9” should read -- claim 15 --.

Signed and Sealed this

Third Day of May, 2005

JON W. DUDAS
*Director of the United States Patent and Trademark Office*